US008723691B2

(12) United States Patent
Li et al.

(10) Patent No.: US 8,723,691 B2
(45) Date of Patent: May 13, 2014

(54) PEDESTRIAN SAFETY SYSTEM

(75) Inventors: Mengyang Li, Hubei (CN); Di Zhang, Hubei (CN)

(73) Assignee: Empire Technology Development LLC, Wilmington, DE (US)

( * ) Notice: Subject to any disclaimer, the term of this patent is extended or adjusted under 35 U.S.C. 154(b) by 424 days.

(21) Appl. No.: 12/761,415

(22) Filed: Apr. 16, 2010

(65) Prior Publication Data

US 2011/0254703 A1 Oct. 20, 2011

(51) Int. Cl.

| | |
|---|---|
| ***G08B 1/08*** | (2006.01) |
| ***G08B 21/00*** | (2006.01) |
| ***G08G 1/095*** | (2006.01) |
| ***G08G 1/123*** | (2006.01) |

(52) U.S. Cl.
USPC ..... 340/944; 340/539.22; 340/540; 340/989

(58) Field of Classification Search
USPC ..... 340/901–952, 994, 539.22, 540, 989
See application file for complete search history.

(56) References Cited

U.S. PATENT DOCUMENTS

| | | | | |
|---|---|---|---|---|
| 4,777,474 | A | 10/1988 | Clayton et al. | |
| 4,952,931 | A * | 8/1990 | Serageldin et al. | 340/902 |
| 5,495,242 | A * | 2/1996 | Kick et al. | 340/902 |
| 5,760,686 | A * | 6/1998 | Toman | 340/540 |
| 5,864,304 | A * | 1/1999 | Gerszberg et al. | 340/903 |
| 5,889,475 | A * | 3/1999 | Klosinski et al. | 340/902 |
| 6,232,887 | B1 * | 5/2001 | Carson | 340/903 |
| 6,980,125 | B1 * | 12/2005 | Barber | 340/917 |
| 7,075,427 | B1 * | 7/2006 | Pace et al. | 340/539.22 |
| 7,356,473 | B2 * | 4/2008 | Kates | 704/271 |
| 2008/0068146 | A1 * | 3/2008 | Cauldwell | 340/435 |
| 2008/0163504 | A1 * | 7/2008 | Smith et al. | 33/268 |
| 2009/0002197 | A1 * | 1/2009 | Cemper | 340/989 |
| 2009/0237233 | A1 * | 9/2009 | Smith | 340/539.1 |

OTHER PUBLICATIONS

Hao Lin-Feng, Wang Hua, Liu Ren-Hao, "A Way of Vehicle Discharge Statistic with Magnetic Detecting," Shanxi Electronic Technology, 55-57, 2006.
http://web.archive.org/web/20100504041834/http://www51.honeywell.com/honeywell/, May 4, 2010.

* cited by examiner

*Primary Examiner* — Daniel Wu
*Assistant Examiner* — Mohamed Barakat
(74) *Attorney, Agent, or Firm* — Ren-Sheng International

(57) ABSTRACT

Techniques are generally described related to a pedestrian safety system. One example pedestrian safety system may include a sound collector configured to collect an audio signal in an environment of a pedestrian; a processor configured to analyze the collected audio signal to determine whether the audio signal is associated with a vehicle and a distance between the vehicle and the pedestrian; and a notification device configured to notify the pedestrian when the processor determines that the audio signal is associated with the vehicle and the distance is less than a predetermined distance.

16 Claims, 4 Drawing Sheets

PEDESTRIAN SAFETY SYSTEM

BACKGROUND

Unless otherwise indicated herein, the approaches described in this section are not prior art to the claims in this application and are not admitted to be prior art by inclusion in this section.

In modern society, pedestrian safety is important, and various approaches have been introduced to improve the safety of pedestrians. For example, audio tactile buttons on controllers at an intersection may assist visually impaired pedestrians to locate the push buttons and use them to safely cross the road. Tactile ground surface detectors may provide visually impaired pedestrians information of a safety footpath. Motion detectors may be mounted on the tops of poles at intersections to detect slow moving pedestrians and delay the change of traffic signals to allow them to cross roads safely. However, current approaches fail to adequately address the needs of hearing impaired pedestrians.

BRIEF SUMMARY

In accordance with some embodiments, the present disclosure may broadly relate to a pedestrian safety system, which includes a sound collector configured to collect an audio signal in an environment of a pedestrian; a processor configured to analyze the collected audio signal to determine whether the audio signal is associated with a vehicle and a distance between the vehicle and the pedestrian; and a notification device configured to notify the pedestrian when the processor determines that the audio signal is associated with the vehicle and the distance is less than a predetermined distance.

In accordance with some other embodiments, the disclosure may broadly refer to a method for warning a hearing impaired pedestrian. The method includes collecting an audio signal from an environment of the hearing impaired pedestrian; analyzing the audio signal based on the frequency and the volume of the audio signal to determine whether the audio signal is associated with a vehicle and a distance between the hearing impaired pedestrian and the vehicle; and notifying the hearing impaired pedestrian when the frequency matches a predetermined frequency and the volume is greater than a predetermined volume.

In yet some other embodiments, the disclosure may be associated with a computer-readable medium which contains a sequence of instructions for warning a hearing impaired pedestrian. When the sequence of instructions is executed by a computing device, the computing device may be caused to collect an audio signal from an environment of the hearing impaired pedestrian, analyze the audio signal based on the frequency and the volume of the audio signal to determine whether the audio signal is associated with a vehicle and a distance between the hearing impaired pedestrian and the vehicle, and notify the hearing impaired pedestrian when the frequency matches a predetermined frequency and the volume is greater than a predetermined volume.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
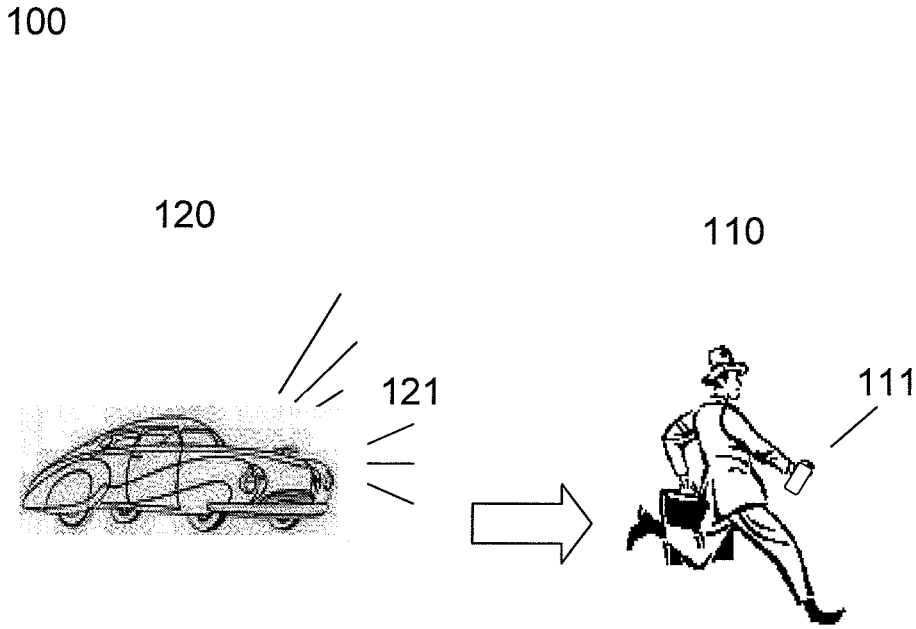
FIG. 1 shows a schematic drawing of an illustrative embodiment of a pedestrian wearing a pedestrian safety system and a vehicle approaching from behind the pedestrian.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to methods, systems, and computer programs related to warning a pedestrian of a hazard or impending danger.

In some embodiments, a pedestrian safety system includes a sound collector and a processor. The sound collector may be configured to collect an audio signal from the environment of the pedestrian. The processor may be configured to process the audio signal and to determine whether a possible hazard exists for the pedestrian. For example, the processor may determine that a vehicle is approaching the pedestrian from the frequency and the volume of the collected audio signal. When the vehicle is sufficiently close to the pedestrian, the processor may be configured to notify the pedestrian of the hazard imposed by the vehicle. The notification may be via a tactile warning (e.g., vibration), a visual warning (e.g., image displayed on a display) or any other suitable means sufficient to alert a hearing impaired pedestrian.

In some embodiments, the pedestrian safety system may further include a magnetic field sensor. The magnetic field sensor may be configured to detect a magnetic field change around the pedestrian. For example, the magnetic field sensor may detect a magnetic field change caused by an approaching vehicle. The processor may be configured to determine whether the magnetic field change exceeds a predetermined value and notify the pedestrian via a tactile warning, a visual warning or any other suitable means as set forth above.

In this disclosure, the term "hearing impaired" may generally refer to a status of a full or partial decrease in the ability to detect, hear, or perceive sounds. An "audio signal" may generally refer to a representation of a sound wave in various forms.

FIG. 1 shows a schematic drawing 100 of an illustrative embodiment of a pedestrian 110 wearing a pedestrian safety system 111 and a vehicle approaching from behind the pedestrian 110. In some embodiments, the pedestrian 110 may be hearing impaired. For example, the pedestrian 110 may be partially or wholly lacking or deprived of the sense of hearing by natural causes or by artificial means (e.g., wearing earphones). When a vehicle 120 approaches the pedestrian 110, especially from behind, the pedestrian 110 may not be aware of the vehicle 120 even if the driver of the vehicle 120 tries to alert the pedestrian by sounding a horn 121. However, with the help of the pedestrian safety system 111 attached or affixed to or carried by the pedestrian 110, the pedestrian 110 may become aware of the approaching vehicle 120.

The pedestrian safety system 111 may be configured to collect audio signals from an environment around the pedestrian 110. For example, the pedestrian safety system 111 may include a directional microphone which collects audio signals from a specific direction (e.g., from the back of the pedestrian 110). In some embodiments, the pedestrian safety system 111 may be configured to identify a sound of a horn generated or made by a vehicle from the collected audio signals. In some embodiments, vehicle horns typically generate an audible sound in a certain frequency or frequency range, and this may be used to distinguish vehicle horn sounds from other sounds or noises in the audio signals. In some other embodiments, the pedestrian safety system 111 may include a database and an audio signal analyzing module. The database may store audio signatures of various vehicle horn sounds. The audio signal analyzing module may be configured to analyze the collected audio signals and determine whether the audio signals are associated with the vehicle horn sounds based on audio signatures stored in the database.

The audio analyzing module may also determine the distance between the vehicle generating the horn sound and the pedestrian. To facilitate the processing of the collected audio signals, the pedestrian safety system 111 may include a band-pass filter to attenuate audio signals having frequencies that are outside of a predetermined range of frequencies or a high-pass filter to attenuate audio signals having frequencies that are below a threshold frequency. After having filtered the collected audio signals, the filtered audio signals may be compared with the audio signatures of the vehicle horn sounds. If a match is found, then the audio signal analyzing module may proceed to determine whether the distance between the vehicle and the pedestrian is less than a predetermined distance and whether to notify the pedestrian of the approaching vehicle through a notification device. The determination may be based on the volume of the collected audio signals. Typically, as a vehicle approaches the pedestrian, the volume of the horn generated by the vehicle and perceived by the pedestrian may also increase. Therefore, in some embodiments, a volume level may be set to correspond to a distance between the vehicle generating the horn sound and the pedestrian. Thus, when the volume of the collected and filtered audio signals is greater than the predetermined volume level, the audio signal analyzing module may determine that the distance between the vehicle and the pedestrian is less than the predetermined distance.

In some other embodiments, the pedestrian safety system 111 may further include a magnetic field analyzing module and a magnetic field sensor to detect a magnetic field change around the pedestrian. The magnetic field sensor may be configured to detect a geomagnetic field change caused by an approaching vehicle. An example magnetic field sensor may be a conventional geomagnetic field sensor, which is configured to detect a geomagnetic field change when a metal object (e.g., a vehicle) is in the proximity of the geomagnetic field sensor. In these embodiments, the magnetic field analyzing module may determine that the magnetic field change is greater than a predetermined value and notify a processing unit of this condition. In response to this notification, the processing unit may be configured to activate the notification device. The notification device may provide a tactile warning (e.g., vibration), a visual warning (e.g., image displayed on a display) or any other suitable means sufficient to alert the pedestrian.

The pedestrian safety system 111 may support one or more user friendly features. For example, the pedestrian safety system 111 may include a feedback circuit, which may be configured to suspend the function of the sound collector and/or the magnetic field sensor after the notification device has notified the pedestrian to avoid unnecessarily and repeatedly notifying the pedestrian. In some other embodiments, the feedback circuit may be configured to deactivate the notification device for a predetermined period of time. The pedestrian safety system 111 may also have a power-saving mechanism. In some embodiments, the magnetic field sensor may be activated in some specific circumstances. For example, when the audio signal analyzing module determines that the audio signals collected from the sound collector include too many signals to analyze, the magnetic field sensor may then be activated to detect whether the magnetic field around the pedestrian changes due to an approaching vehicle. The pedestrian safety system 111 may be worn on a wrist of a pedestrian in accordance with some embodiments of the disclosure.

Figure 2:
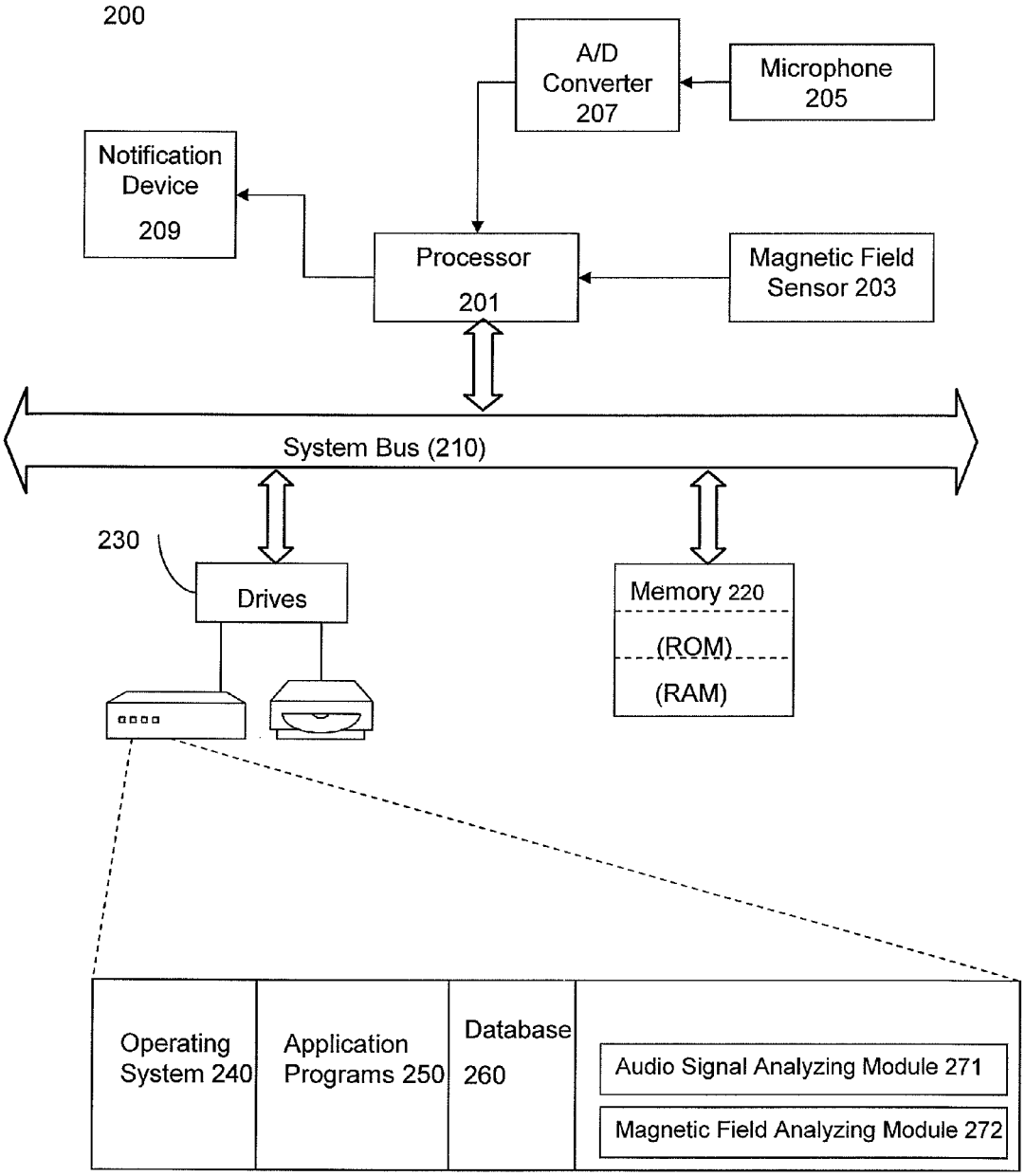
FIG. 2 shows a block diagram of an illustrative embodiment of a computing device adapted to warn a pedestrian of an approaching vehicle.

FIG. 2 shows a block diagram of an illustrative embodiment of a computing device 200 adapted to warn a pedestrian of an approaching vehicle. As depicted, the computing device 200 includes a processor 201, a memory 220 and one or more drives 230. The drives 230 and their associated computer storage media, provide storage for computer readable instructions, data structures, program modules or other data for the computing device 200. The drives 230 may include an operating system 240, an application program 250, a database 260, an audio signal analyzing module 271, and a magnetic field analyzing module 272. The processor 201 controls the operations of the computing device 200.

The computing device 200 may also include a microphone 205 configured to collect audio signals from the environment surrounding the pedestrian. The collected audio signals may be transformed to digital signals through an analog/digital converter 207. The collected audio signals may be saved in the memory 220. The audio signal analyzing module 271 may be executed to analyze the collected audio signals. In some embodiments, the audio signal analyzing module 271 may compare the collected audio signals with the audio signatures for the various horn sounds stored in the database 260. Based on the comparison results, the audio signal analyzing module 271 may determine whether the collected audio signal is associated with a specific horn sound of a vehicle, estimate a distance between the source of the collected audio signal and the pedestrian who is carrying the computing device 200, and provide an indication that the vehicle is within a predetermined distance from the pedestrian. For example, the audio signal analyzing module 271 can transmit a first signal to the processor 201 when the distance between the vehicle and the pedestrian is less than a predetermined distance.

The computing device 200 may further include a magnetic field sensor 203 configured to detect a magnetic field change around the pedestrian. The detected magnetic field change signal may be saved in the memory 220, and the magnetic field analyzing module 272 may be executed to analyze the detected magnetic field change signal. The magnetic field analyzing module 272 may perform operations including, but not limited to, determining whether the magnetic field around the pedestrian changes, and providing an indication of a change in the magnetic field around the pedestrian. For example, the magnetic field analyzing module 272 can transmit a second signal to the processor 201 when the magnetic field change is greater than a predetermined value.

In some embodiments, the processor 201 may activate a notification device 209 based on the first signal. In some other embodiments, the processor 201 may activate the notification device 209 based on the second signal. In some other alternative embodiments, the processor 201 may activate the notification device 209 based on the first signal and the second signal. The notification device 209 may be configured to notify the pedestrian.

The computing device 200 may be implemented as a portion of a small-form factor portable (or mobile) electronic device such as a cell phone, a personal data assistant (PDA), a personal media player device, a wireless web-watch device, a personal headset device, an application specific device, or a hybrid device that includes any of the above functions. The computing device 200 may also be implemented as a personal computer including both laptop computer and non-laptop computer configurations.

Figure 3:
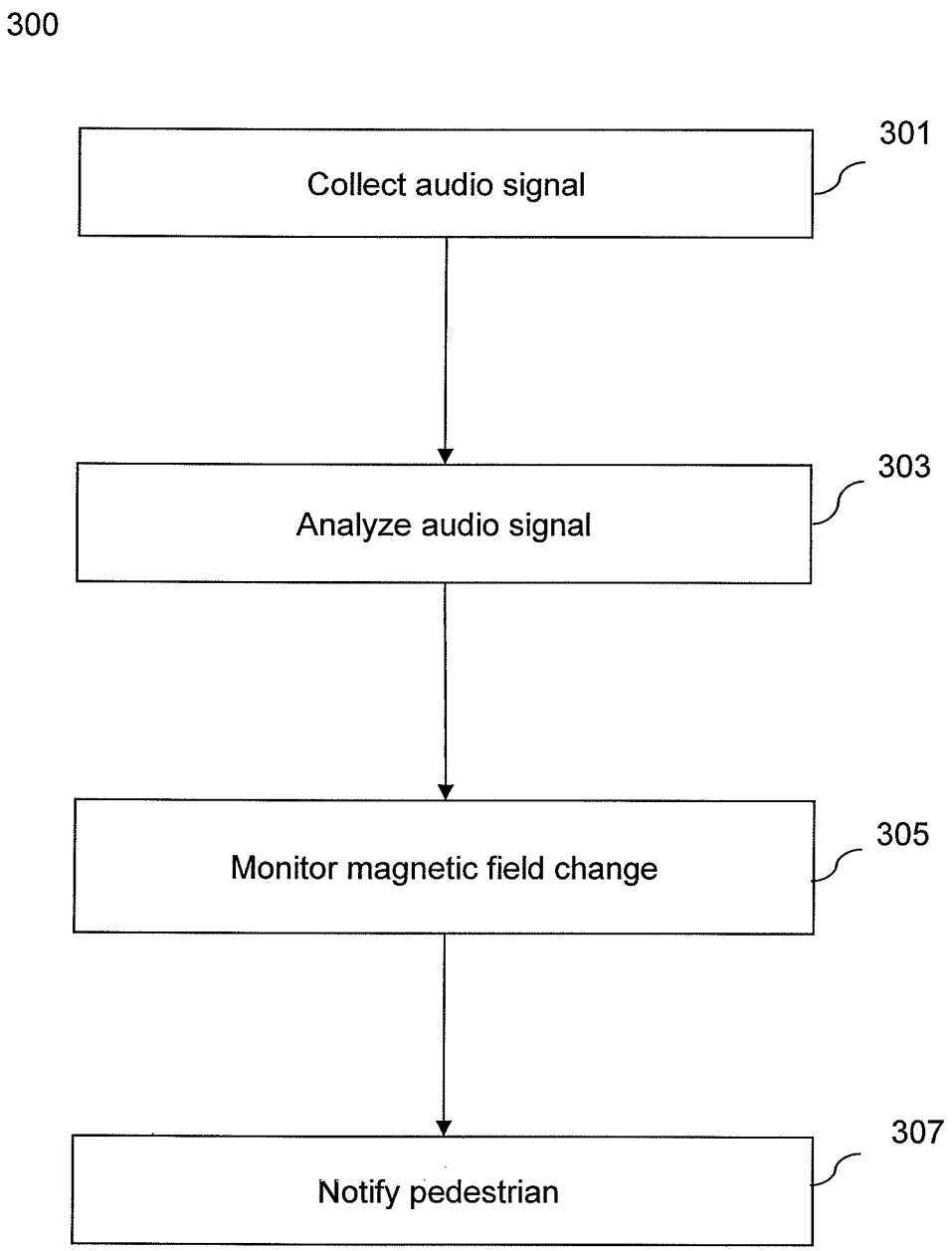
FIG. 3 is a flow chart of an illustrative embodiment of a method for warning a pedestrian of an approaching vehicle.

FIG. 3 is a flow chart of an illustrative embodiment of a method 300 for warning a pedestrian of an approaching vehicle. The method 300 may include one or more operations, functions, or actions as illustrated by blocks 301, 303, 305, and/or 307. The various blocks are not intended to be limiting to the described embodiments. For example, one skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

In block 301 (collect audio signal), an audio signal is collected from the environment of the pedestrian. In one example implementation, a component of the aforementioned computing device 200, such as the microphone 205, may collect the audio signal. In block 303 (analyze audio signal), the collected audio signal may be analyzed based on its frequency and the volume. Continuing the example implementation, the audio signal analyzing module 271 may analyze the collected audio signal. The audio signal may further be analyzed to determine whether a vehicle is approaching and the driver is warning the pedestrian with a horn. The frequency of the horn may be unique and distinguished from other noises in the audio signal. The analysis may include comparing the collected audio signal with a set of pre-stored audio signatures to determine whether the collected audio signal is associated with a horn of a vehicle. The analysis may further include analyzing the volume of the audio signal to determine the distance between the vehicle where the horn originates and the pedestrian.

In block 305 (monitor magnetic field change), a magnetic field change around the pedestrian is monitored. Continuing the example implementation, the magnetic field analyzing module 272 may monitor a magnetic field change around the pedestrian. The magnetic field may be the geomagnetic field. When a vehicle approaches to the pedestrian within a distance, the geomagnetic field around the pedestrian may be changed and the change of the geomagnetic field may be measured.

In block 307 (notify pedestrian), the pedestrian is notified when the audio signal analysis indicates that the collected audio signal is associated with a horn of a vehicle and the vehicle is within a predetermined distance from the pedestrian. Continuing the example implementation, the processor 201 may activate the notification device 209 to notify the pedestrian. In some embodiments, the pedestrian may be notified based on the detected change in the magnetic field around the pedestrian. In still other embodiments, the pedestrian may be notified based on the combination of audio signal analysis and the detected change in the magnetic field around the pedestrian. When the pedestrian is hearing impaired, the notification can be done through a vibrator or an image display.

Figure 4:
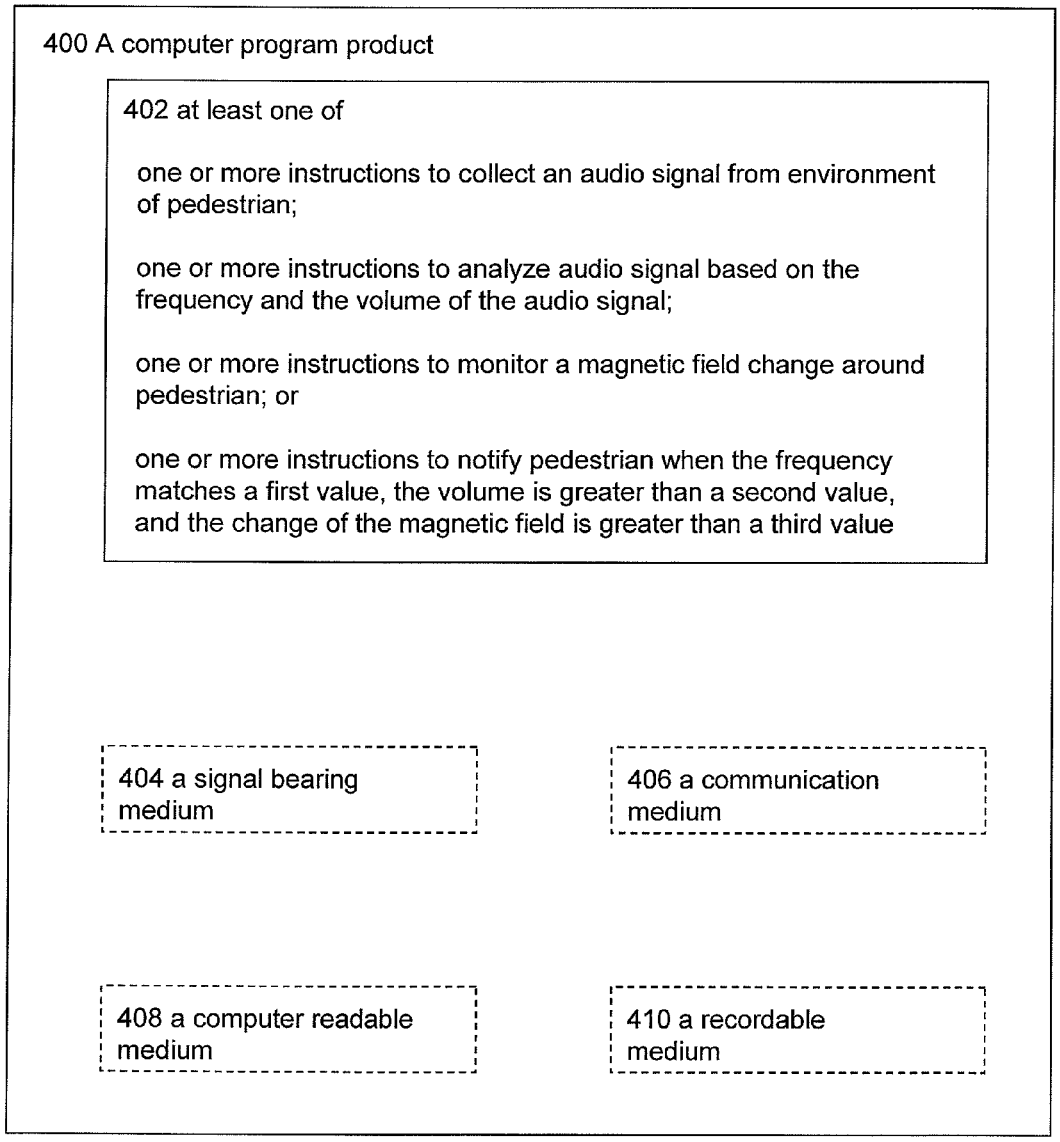
FIG. 4 shows a block diagram illustrating a computer program product adapted to warn a pedestrian when a vehicle is approaching in accordance with at least some embodiments of the present disclosure.

FIG. 4 is a block diagram illustrating a computer program product 400 for managing power consumption of a processor in accordance with at least some embodiments of the present disclosure. Computer program product 400 may include one or more sets of executable instructions 402 for executing the method described above and illustrated in FIG. 3. Computer program product 400 may be transmitted in a signal bearing medium 404 or another similar communication medium 406. Computer program product 400 may also be recorded in a computer readable medium 408 or another similar recordable medium 410.

There is little distinction left between hardware and software embodiments of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link and/or channel, a wireless communication link and/or channel, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A pedestrian safety system, comprising:

a sound collector configured to collect an audio signal in an environment of a pedestrian;

a magnetic field detector configured to detect a magnetic field change around the pedestrian, wherein the magnetic field detector is activated when noises in the audio signal exceed a predetermined level;

a processor configured to analyze the collected audio signal to determine whether the audio signal is associated with a vehicle and a distance between the vehicle and the pedestrian, and configured to determine whether the detected change of the magnetic field is caused by the vehicle approaching the pedestrian; and a notification device configured to notify the pedestrian when the processor determines that the audio signal is associated with the vehicle and the distance is less than a predetermined distance, or when the processor determines that the detected change of the magnetic field is caused by the vehicle approaching the pedestrian.

2. The pedestrian safety system of claim 1, wherein the sound collector is a directional microphone configured to collect the audio signal from a first direction.

3. The pedestrian safety system of claim 1, wherein the processor is further configured to filter out the collected audio signal when the collected audio signal has a frequency lower than a threshold frequency.

4. The pedestrian safety system of claim 1, wherein the processor is further configured to analyze the collected audio signal based on the volume of the collected audio signal.

5. The pedestrian safety system of claim 1, further comprising a feedback circuit configured to transmit a signal to the processor to deactivate the sound collector for a period of time after the notification device notifies the pedestrian.

6. The pedestrian safety system of claim 1, wherein the magnetic field is a geomagnetic field.

7. The pedestrian safety system of claim 1, wherein the processor is further configured to determine whether the change of the magnetic field is greater than a predetermined value.

8. The pedestrian safety system of claim 7, wherein the notification device is further configured to notify the pedestrian when the processor determines that the change of the magnetic field is greater than the predetermined value.

9. A pedestrian safety system, comprising:

a sound collector configured to collect an audio signal in an environment of a pedestrian;

a magnetic field detector configured to detect a magnetic field change around the pedestrian;

a processor configured to analyze the collected audio signal to determine whether the audio signal is associated with a vehicle and a distance between the vehicle and the pedestrian, and configured to determine whether the detected change of the magnetic field is caused by the vehicle approaching the pedestrian, wherein the magnetic field detector is activated when the processor determines that noises in the audio signal exceed a predetermined level; and a notification device configured to notify the pedestrian when the processor determines that the audio signal is associated with the vehicle and the distance is less than a predetermined distance, or when the processor determines that the detected change of the magnetic field is caused by the vehicle approaching the pedestrian.

10. The pedestrian safety system of claim 1, wherein the pedestrian safety system is worn on the wrist of the pedestrian.

11. A method for warning a hearing impaired pedestrian, comprising:

collecting an audio signal from an environment of the hearing impaired pedestrian;

detecting a magnetic field change around the hearing impaired pedestrian when noises in the audio signal exceed a predetermined level;

analyzing the audio signal based on the frequency and the volume of the audio signal to determine whether the audio signal is associated with a vehicle and a distance between the hearing impaired pedestrian and the vehicle;

determining whether the detected change of the magnetic field is caused by the vehicle approaching the hearing impaired pedestrian; and notifying the hearing impaired pedestrian when the frequency matches a predetermined frequency and the volume is greater than a predetermined volume, or when the detected change of the magnetic field is caused by the vehicle approaching the hearing impaired pedestrian.

12. The method of claim 11, further comprising notifying the hearing impaired pedestrian when the change of the magnetic field is greater than a predetermined value.

13. The method of claim 12, further comprising deactivating the monitoring when noises in the audio signal are less than a predetermined level.

14. A non-transitory computer-readable medium containing a sequence of instructions to warn a hearing impaired pedestrian, which when executed by a computing device, cause the computing device to:

collect an audio signal from an environment of the hearing impaired pedestrian;

detect a magnetic field change around the hearing impaired pedestrian when noises in the audio signal exceed a predetermined level;

analyze the audio signal based on the frequency and the volume of the audio signal to determine whether the audio signal is associated with a vehicle and a distance between the hearing impaired pedestrian and the vehicle;

determine whether the detected change of the magnetic field is caused by the vehicle approaching the hearing impaired pedestrian; and notify the hearing impaired pedestrian when the frequency matches a predetermined frequency and the volume is greater than a predetermined volume, or when the detected change of the magnetic field is caused by the vehicle approaching the hearing impaired pedestrian.

15. The non-transitory computer-readable medium of claim 14, further including a sequence of instructions, which when executed by the computing device, causes the computing device to notify the hearing impaired pedestrian when the change of the magnetic field is greater than a predetermined value.

16. The non-transitory computer-readable medium of claim 14, further including a sequence of instructions, which when executed by the computing device, causes the computing device to deactivate the monitoring of the magnetic field change when noises in the audio signal are less than a predetermined level.

* * * * *